US005116046A

United States Patent [19]

Pace

[11] Patent Number: 5,116,046

[45] Date of Patent: May 26, 1992

[54] MULTIPURPOSE GOLFER'S TOOL

[76] Inventor: Lawrence A. Pace, 285 Roycroft Blvd., Snyder, N.Y. 14226

[21] Appl. No.: 725,659

[22] Filed: Jul. 3, 1991

[51] Int. Cl.[5] ..... A63B 57/00

[52] U.S. Cl. ..... 273/32 B; 273/162 R

[58] Field of Search ..... 273/32 B, 32 R, 162 R, 273/162 F, 32 C, 162 B, 162 C, 162 D, 32 A

[56] References Cited

U.S. PATENT DOCUMENTS

| | | | |
|---|---|---|---|
| 3,360,807 | 1/1968 | Mauck | 273/162 FX |
| 3,870,300 | 3/1975 | Amentola | 273/32 B |
| 4,063,731 | 12/1977 | Kitay | 273/32 B |
| 4,545,579 | 10/1985 | McCain | 273/162 R |
| 4,627,621 | 12/1986 | Tate | 273/32 B |
| 4,991,839 | 2/1991 | Lumbattis | 273/162 R |
| 5,012,872 | 5/1991 | Cohn | 273/32 B |

*Primary Examiner*—George J. Marlo
*Attorney, Agent, or Firm*—Howard J. Greenwald

[57] ABSTRACT

A one-piece, plastic golfer's tool is disclosed which is adapted to be removably attached to the shaft of a golf club. This tool contains a top section containing two curved, resilient legs and a bottom section containing two wedge-shaped legs; the two sections lie in the same plane, and the bottom section is longer than the top section. The resilient legs on the top section define a substantially circular arc which extends at least 210 degrees.

1 Claim, 2 Drawing Sheets

MULTIPURPOSE GOLFER'S TOOL

FIELD OF THE INVENTION

A multipurpose golfer's air which can be used to repair ball marks on greens, clean the cleats of a golfer's shoes, and securely cradle and elevate the grip of a a golf club when the head of the club is placed on the ground.

BACKGROUND OF THE INVENTION

Golfers often place their golf clubs on the ground while playing golf. However, such ground is often wet and/or comprised of loose dirt, sand, or chemicals used when golf greens are fertilized. Contact of the golf club grip with moisture and/or dirt often adversely affects the grip and the ability of the golfer to hold the club, tends to cause corrosion, and fouls the surface of the grip.

A golf club cradle designed to keep a portion of a golf club from contacting the ground is disclosed in U.S. Pat. No. Des. D279,309 of Rosen et al. The cradle of this patent is comprised of two arcuate surfaces. Although the golf club may rest on either of these arcuate surfaces, it is not securely attached to either of such surfaces; and only a minimal amount of force will cause the golf club to fall from such cradle. Furthermore, the device of this patent is not designed to perform any function except cradling a golf club.

It is an object of this invention to provide a multi-purpose golfer's tool which is adapted to be securely and removably attached to the shaft of a golf club;

It is another object of this invention to provide a multipurpose golfer's tool which, once it has been attached to the shaft of a golf club, may only be removed by exerting a substantial amount of force on it;

It is yet another object of this invention to provide a golfer's tool which is adapted to repair ball marks on putting greens;

It is yet another object of this invention to provide a golfer's tool which is adapted to clean the cleats of a golfer's shoes.

SUMMARY OF THE INVENTION

In accordance with this invention, there is provided an integral golfer's tool which consists essentially of plastic material. This tool contains a proximal portion (which has two spaced-apart, substantially wedge-shaped legs) and a distal portion (which has two spaced apart, substantially resilient legs). The resilient legs on the distalportion define a substantially circular arc which extends at least about 210 degrees.

DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
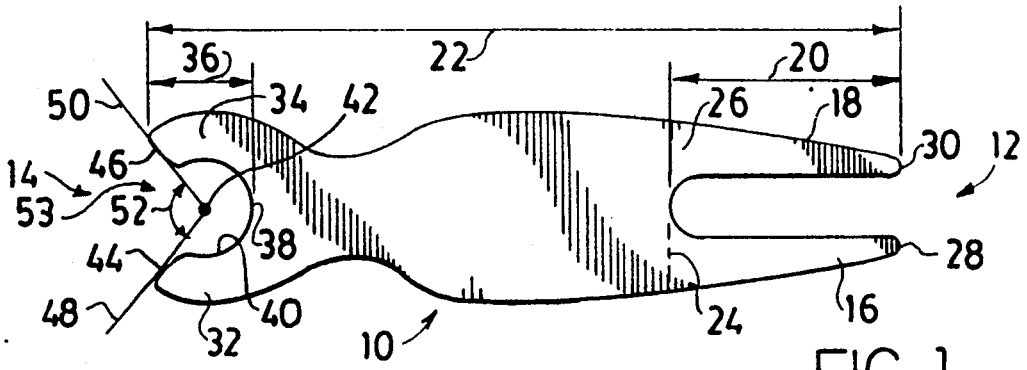
FIG. 1 is a a top view of one preferred embodiment of the golfer's tool of this invention.

FIG. 1 illustrates one of the preferred embodiments of applicant's golfer's tool 10.

Tool 10 preferably consists essentially of a thermoplastic material. As is known to those skilled in the art, a thermoplastic is a high polymer that softens when exposed to heat and returns to its original condition when cooled to room temperature. Some preferred thermoplastic materials are described on pages 19–154 of the "Modern Plastics Encyclopedia," which is the Mid-October 1990 issue of "Modern Plastics," Volume 67, Number 11 (Modern Plastics, Highstown, New Jersey), the disclosure of which is hereby incorporated by reference into this specification.

Some of the preferred thermoplastic materials which may be used in the golfer's tool 10 of this invention include acetal polymers, acrylic plastics, cellulosic resins, fluoroplastic resins, nitrile resins (such as acrylonitrile), polyamides, polycarbonate resins, polyester resins (such as polyethylene terephthalate), linear polyethylene, polypropylene, styrenic resins (such as acrylonitrile—butadiene—styrene), polystyrene, polyvinyl chloride, polyurethane prepolymer, and the like.

It is preferred to produce the golfer's aid 10 by injection molding. The injection molding process is well known to those skilled in the art and is described, e.g., at pages 83–156 of Joel Frados, "Plastics Engineering Handbook," Fourth Edition (Van Nostrand Reinhold Company, New York, 1976).

Referring again to FIG. 1, it will be seen that golfer's tool 10 is comprised of a proximal end 12 and a distal end 14.

Proximal end 12 is comprised of a pair of spaced apart legs 16 and 18. In one preferred embodiment, each of these legs 16 and 18 has a length 20 which is from about 20 to about 50 percent of the length 22 of golfer's tool 10; the length of leg 16 may be the same as or different from the length of leg 18. In one embodiment, each of legs 16 and 18 has a length 20 which is from about 25 to about 40 percent of the length 22 of golfer's tool 10.

Each of legs 16 and 18 are preferably substantially wedge-shaped, converging from their respective bases 24 and 26 to their respective tips 28 and 30.

Distal end 14 is comprised of two spaced-apart, resilient legs 32 and 34 which, in combination, provide both a means for attaching tool 10 to the shaft of a golf club and, additionally, means for preventing the removal of tool 10 when a golf club to which tool 10 is attached is lifted from the ground.

The term resilient, as used in this specification, refers to a material which the power to return to its original shape after distortion within elastic limits. Thus, because legs 32 and 34 will return to their original shape after the shaft of golf club which had been used to stretch them apart is removed from the interior surface they define, such legs are resilient.

In one preferred embodiment, the length 36 of leg 32 and/or leg 34, as measured from base 38, is from about 8 to about 30 percent of the length 22 of golfer's tool 10. The length 36 of leg 32 and/or leg 34 is also from about 20 to about 70 percent of the average length length 20 of wedge-shaped legs 16 and 18; the shortest of legs 32 and 34 is always shorter than the shortest of legs 16 and 18.

In one preferred embodiment, length 36 is from about 40 to about 60 percent of length 20.

Legs 32 and 34 define an interior, arcuate surface 40. The term arcuate, as used in this specification, refers to a substantially circular shape all of whose points are substantially equidistant from a centerpoint. Thus, referring to FIG. 1, the distance from centerpoint 42 to any point on the interior surface of arcuate surface 40 (the radius) is substantially the same.

Arcuate surface 40 extends from edge 44 to edge 46. When lines 48 and 50 are drawn from centerpoint 42 so that they are substantially tangential to surfaces 44 and 46, respectively, a angle 52 is formed at the intersection of lines 48 and 50. Angle 52 is preferably less than 150 degrees and, more preferably, less than 120 degrees. Thus, it can be said that arcuate surface 40 is defined by an arc which preferably extends at least about 210 degrees and, more preferably, at least about 240 degrees; that is, if one were to draw an imaginary circle 53 around centerpoint 42, at least 210 degrees of such circle is defined by arcuate surface 40.

The radius defining arcuate surface 40 is preferably less than the radius defining the shaft of the golf club. Thus, in order to attach tool 10 to the shaft of a golf club (not shown), the shaft is forced against surfaces 44 and 46. The forces thus applied against surfaces 44 and 46 tend to spread legs 32 and 34 apart, allowing the shaft to enter and be contiguous with arcuate surface 40 as legs 32 and 34 retract onto the shaft.

Once the shaft is attached to golfer's tool 10, it can only be removed therefrom by applying sufficient force(s) on legs 32 and 34 to separate them again so that the shaft of the golf club can be removed. Unlike the situation with prior art golf club cradles, the force of gravity will not in and of itself by sufficient to remove the shaft from its connection with tool 10.

Figure 2:
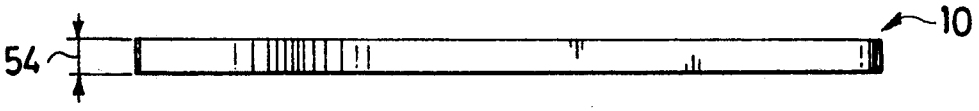
FIG. 2 is a side view of the golfer's tool of FIG. 1.

Referring to FIG. 2, it will be seen that tool 10 preferably has a thickness 54 which is from about 2 to about 20 percent of the length 22 of tool 10. In one embodiment, thickness 54 is from about 5 to about 20 percent of the length 22 of tool 10.

Figure 3:
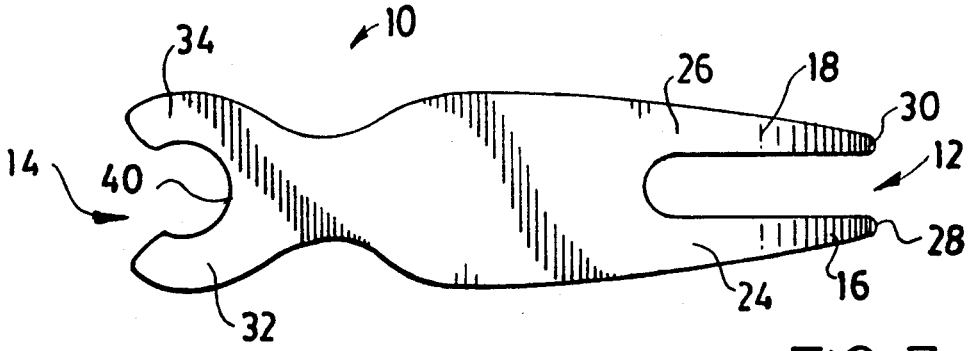
FIG. 3 is a top view of another preferred embodiment of the golfer's tool of this invention.
Figure 4:
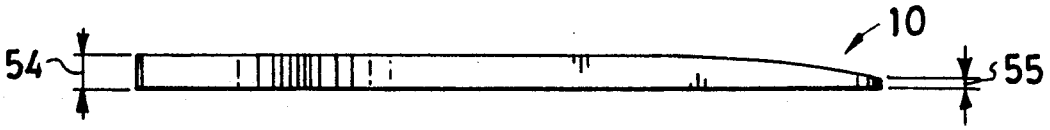
FIG. 4 is a side view of the golfer's tool of FIG. 3.

FIGS. 3 and 4 illustrate another preferred embodiment in which the thickness of golfer's tool 10 is not uniform, varying from one end to another. Thus, referring to FIG. 3, it will be seen that the thickness 54 of one end of tool 10 is greater than the thickness 55 of the other end of tool 10.

Figure 5:
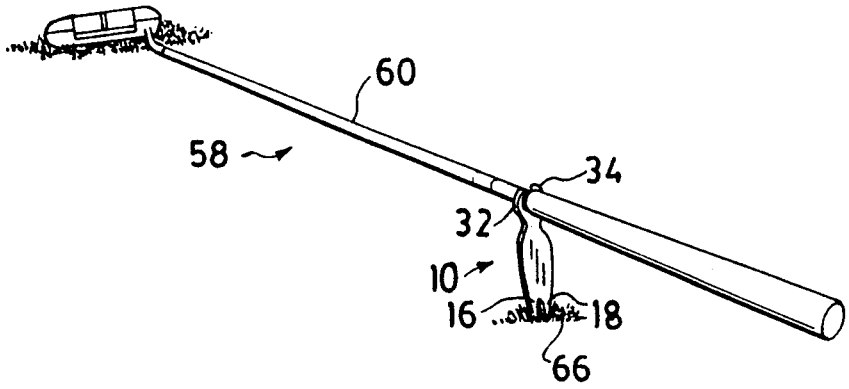
FIGS. 5, 6, and 7 illustrate how the golfer's tool of FIG. 1 may be used, respectively, to support a golf club on the ground, to clean the cleats of a golfer's shoes, and to repair ball marks in a golf course putting green.

FIG. 5 illustrates how tool 10 may be used to support a golf club 58. The shaft 60 of the golf club 58 is press fit into arcuate surface 40, and thereafter the head 62 of the golf club 58 is placed on the ground. Tool 10 and head 62 form a two-pronged support which keeps shaft 60 and grip 64 from contacting ground 66.

Figure 6:
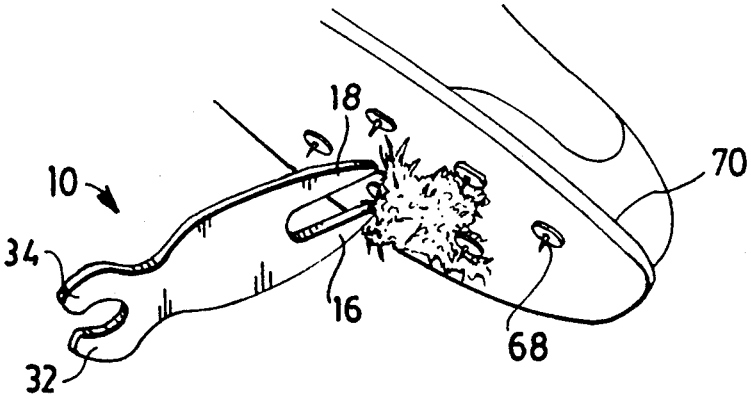

FIG. 6 illustrates how tool 10 may be used to remove dirt from the cleats 68 of a golfer's shoe 70.

Figure 7:
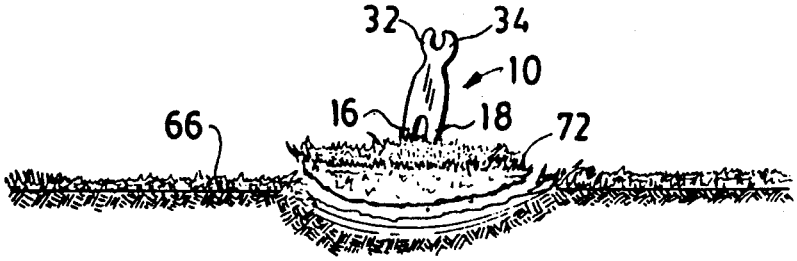

FIG. 7 illustrates how tool 10 may be used to repair a divot 72 in the ground 66.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A golfer's tool adapted to be removably attached to the shaft of a golf club, wherein said golfer's tool consists essentially of a one piece plastic member includes a planar proximal portion and a planar distal portion, wherein said proximal portion and said integral portion are integrally joined to each other, and wherein:

(a) said proximal portion is comprised of two spaced-apart, substantially wedge-shaped legs terminating in tips adapted to penetrate a putting green for repairing ball marks and supporting a golf club thereon each of which has a length which is from 20 to 50 percent of the total length of said golfer's tool;

(b) said distal portion is comprised of two spaced apart, arcuate, substantially resilient legs, wherein said resilient legs define a substantially circular arc which extends at least 210 degrees so that said resilient legs can be snap fitted onto said shaft of said golf club when pressed transversely thereon to support the grip end of said shaft above the surface of a putting green, wherein each of said substantially resilient legs has a length which is from 10 to 30 percent of the total length of said golfer's tool;

(c) said proximal section and said distal portion are substantially coplanar; and (d) the length of each of said substantially resilient legs is from 40 to 60 percent of the average length of said substantially wedge-shaped legs, so that said substantially resilient legs can be snap fitted onto said golf club to provide a club support.

* * * * *